United States Patent [19]

Kuntzmann et al.

[11] Patent Number: 4,871,950

[45] Date of Patent: Oct. 3, 1989

[54] WIDE BAND DEVICE FOR COUPLING BETWEEN THE DELAY LINE OF A TRAVELLING WAVE TUBE AND THE EXTERNAL CIRCUIT TRANSMITTING THE ENERGY OF THE TUBE

[75] Inventors: Jean C. Kuntzmann, Boulogne-Billancourt; Noël Santonja, Creteil, both of France

[73] Assignee: Thomson-CSF, Paris, France

[21] Appl. No.: 133,739

[22] Filed: Dec. 16, 1987

[30] Foreign Application Priority Data

Dec. 19, 1986 [FR] France ..... 86 17879

[51] Int. Cl.[4] ..... H01J 25/34; H01J 25/36

[52] U.S. Cl. ..... 315/393; 315/3.5; 315/39

[58] Field of Search ..... 315/39, 39.3, 3.5, 5.39

[56] References Cited

U.S. PATENT DOCUMENTS

| | | | |
|---|---|---|---|
| 2,761,915 | 9/1956 | Pierce | 315/5.39 |
| 2,922,961 | 1/1960 | Robertson | 333/6 |
| 3,188,583 | 6/1965 | Boyd | 333/26 |
| 3,602,766 | 8/1971 | Grant | 315/39.3 |
| 4,004,180 | 1/1977 | Gross | 315/39.3 |
| 4,147,956 | 4/1979 | Horigome et al. | 315/39.3 |

FOREIGN PATENT DOCUMENTS

| | | |
|---|---|---|
| 2485801 | 12/1981 | France . |
| 2531575 | 2/1984 | France . |

*Primary Examiner*—Donald J. Yusko
*Assistant Examiner*—Brian Palladino
*Attorney, Agent, or Firm*—Spivak Oblon

[57] ABSTRACT

A wide band device is provided for coupling between the delay line of a travelling wave tube and the external circuit transmitting the energy of the tube, comprising a coupling wave guide having a single ridge, connected on one side to the delay line and on the other being extended by one of the two ridges of the output guide, the section of the coupling guide increasing progressively, with constant impedance from the line to the output guide whereas this latter has an impedance transformer providing impedance matching between its standard guide part and the coupling guide.

3 Claims, 5 Drawing Sheets

PRIOR ART FIG_1-b
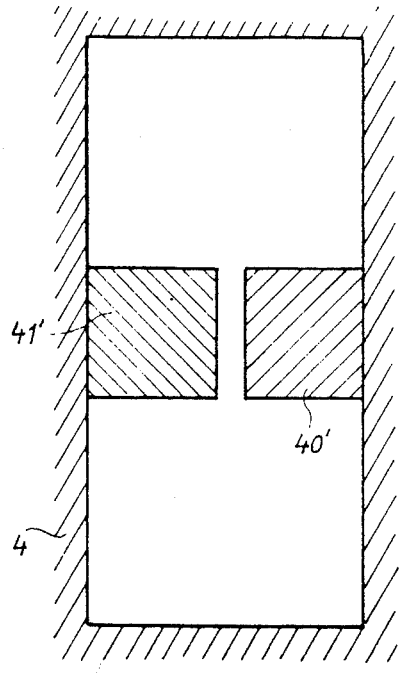
FIG_1-a
PRIOR ART
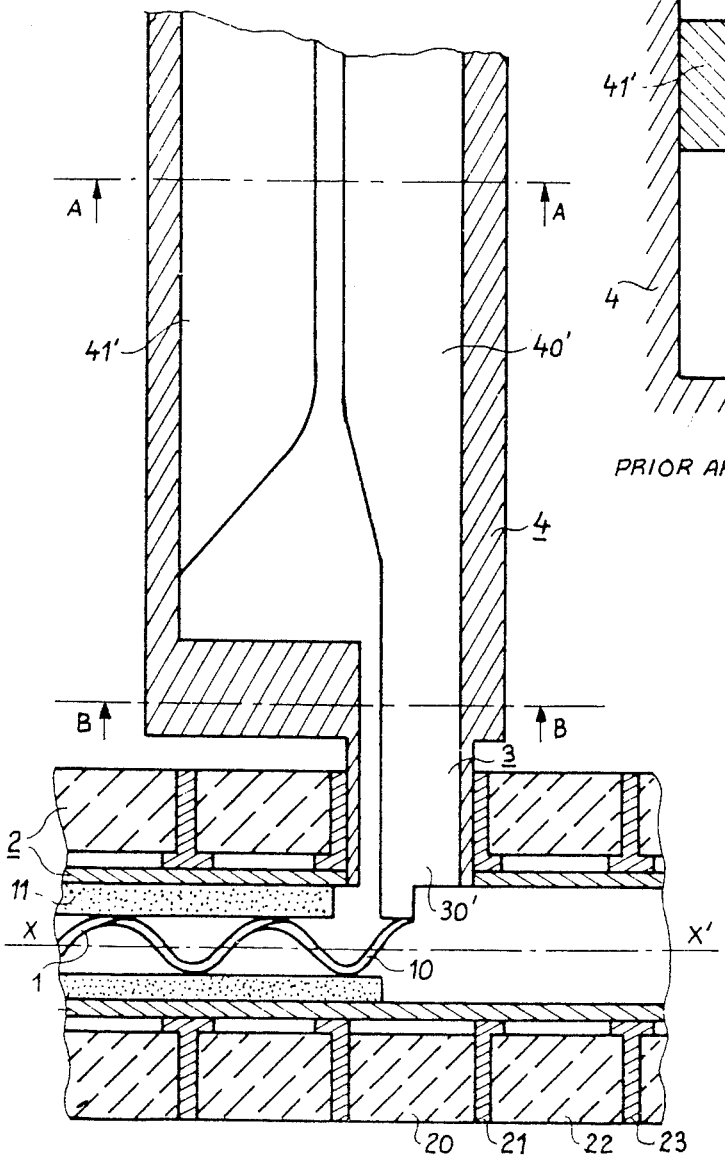
PRIOR ART FIG_1-c
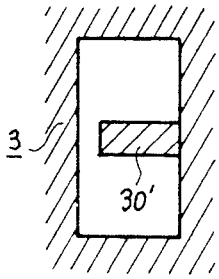

FIG_2-a
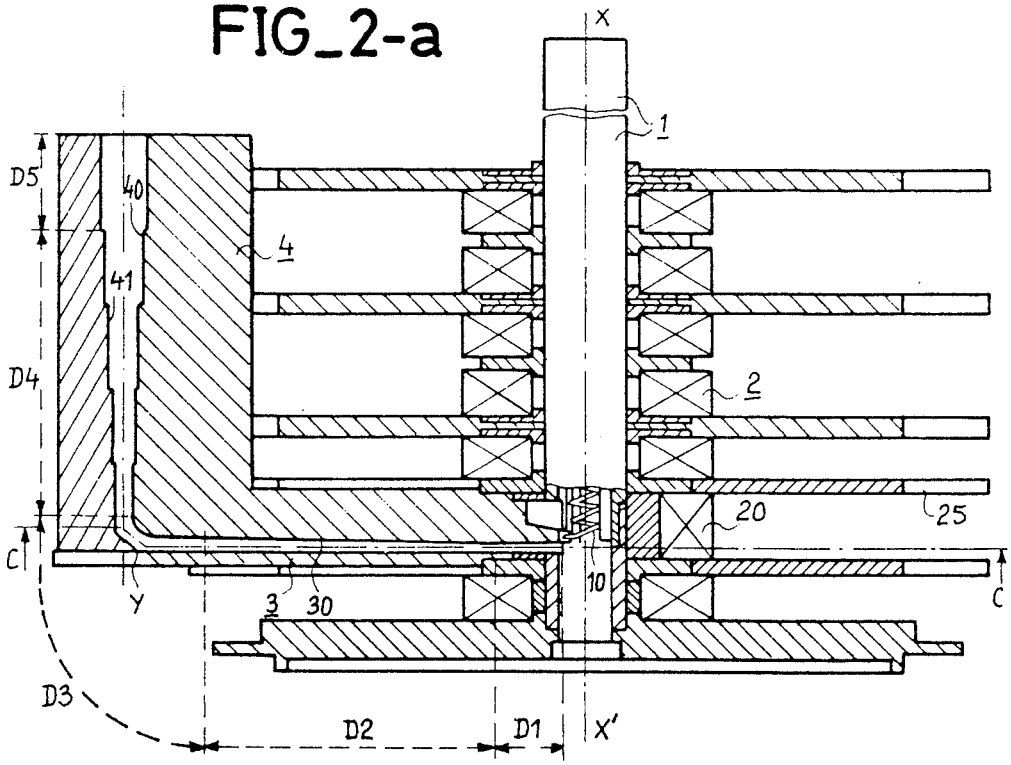
FIG_2-b
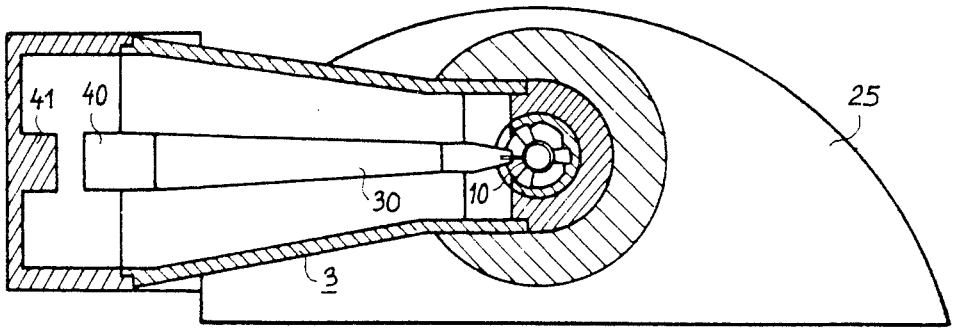

FIG_3-a
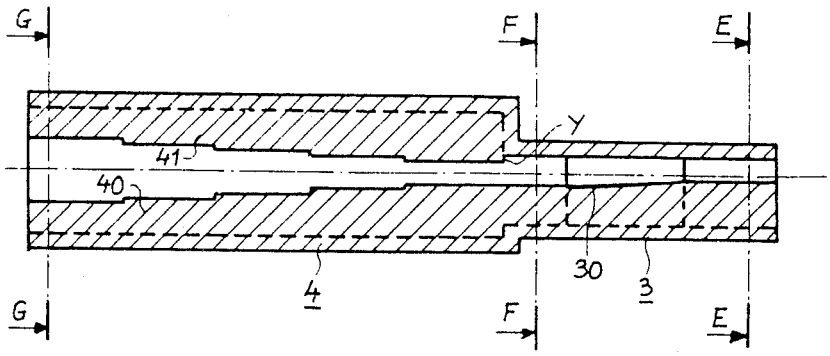
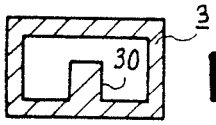
FIG_3-b
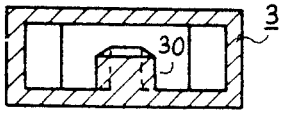
FIG_3-c
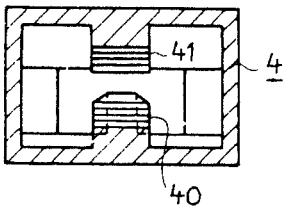
FIG_3-d

WIDE BAND DEVICE FOR COUPLING BETWEEN THE DELAY LINE OF A TRAVELLING WAVE TUBE AND THE EXTERNAL CIRCUIT TRANSMITTING THE ENERGY OF THE TUBE

BACKGROUND OF THE INVENTION

The present invention relates to a device for coupling between, on the one hand, the delay line of a power travelling wave tube, in which the electron beam is focused by means of alternate permanent annular magnets and, on the other hand, an external circuit for transmitting the energy of the tube, formed by a wave guide with double ridge; the invention relates more especially to a device having a small wave guide, generally with a single ridge, of reduced dimensions so as not to exceed the thickness, measured parallel to the axis of the tube, of that one of the permanent magnets which it passes through for providing coupling between the delay line situated inside the focuser and the double ridge wave guide situated outside the focuser. In the context of this disclosure, the term "ridge" is defined as being parallel to the axis of the waveguide, as opposed to a "step" which is defined as being perpendicular to the axis of the guide.

Such coupling devices are known from the French patent 2 485 801 filed on the 27 June 1980, where the small wave guide is a straight guide which opens into an output wave guide, with one of the two ridges of the output guide forming an extension of the ridge of the small guide and the other of the two ridges which gradually increases until it disappears before reaching the end of the double ridge guide coupled to the small guide. Such a coupling device, an embodiment of which will be described in connection with FIG. 1 of this text, has an insufficient band width for certain applications; in addition, because of its construction, it is fairly bulky.

SUMMARY OF THE INVENTION

The purpose of the present invention is to reduce the above mentioned drawbacks.

This is obtained in particular by providing an impedance change in the output guide, by short circuiting that one of the two ridges of the output guide which does not form the extension of the ridge of the small guide and by progressively reducing, from the double ridge guide to the delay line, the dimensions of the small guide but keeping a substantially constant impedance. Subsidiarily, in order to reduce the size of the assembly, the small guide is bent so as to be able to dispose the double ridge output guide for example parallel to the travelling wave tube.

According to the present invention there is provided a coupling device between the delay line of a travelling wave tube and the external circuit transmitting the energy of the tube formed by a first wave guide having a first and a second ridge, this device including a second wave guide coupled in a junction plane to the first guide and having a single ridge, this single ridge having one end connected to the delay line and one end connected to the first ridge, said second ridge being short circuited in the junction plane, said first guide comprising an impedance transformer, said second guide being with substantially constant impedance and the width of said second guide being at least substantially equal to that of the first guide in the junction plane and decreasing in the direction of the delay line.

BRIEF DESCRIPTION OF THE DRAWINGS

The present invention will be better understood and other characteristics will be clear from the following description and the related Figures which show:

FIGS. 1*a* to 1*c* sections relative to a coupling device of the prior art.

FIGS. 2*a* and 2*b* sections relative to a first coupling device in accordance with the invention, FIGS. 3*a* to 3*d* sections relative to a second coupling device in accordance with the invention, FIGS. 4 to 6 views with parts cut away of coupling devices of the invention.

In the different Figures, the corresponding elements are designated by the same references.

MORE DETAILED DESCRIPTION

Figure 4:
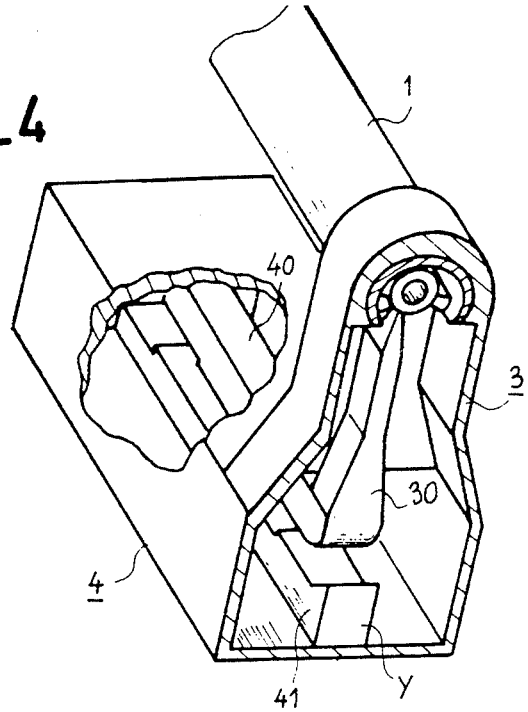

FIGS. 1*a* to 1*c* are sectional views of a coupling device described in French patent 2 485 801.

FIG. 1*a* shows a delay line 1 of a travelling wave tube; it is a helical line, with axis XX', with its helix 10 and its centering rods such as 11. The delay line 1 is disposed in a focuser 2 having alternate annular permanent magnets such as 20, 22 separated by annular pole masses such as 21, 23. An external circuit for transmitting the energy of the tube, formed by a rectangular guide 4, with two ridges 40', 41', is coupled to the delay line 1. The coupling device between line 1 and guide 4 includes a small guide 3 which passes through magnet 20 without extending beyond the width, measured parallel to axis XX', of this magnet; guide 3 has a ridge 30' which, on the one hand, is welded to the end of helix 10 and, on the other hand, extends into the ridge 40' of guide 4. Guides 3 and 4 are straight guides disposed perpendicularly to axis XX'; their transverse dimensions are constant so that the junction between these two guides is provided by a sudden transition in the two transverse dimensions of the guides; the ridge 41' of guide 4 gradually decreases until it disappears completely before reaching the end of guide 4 coupled to the small guide 3.

FIGS. 1*b* and 1*c* are sectional views of guide 4 and of the small guide 3 through sectional planes whose respective lines AA and BB are shown in FIG. 1*a*.

With a construction such as the one shown in FIGS. 1*a* to 1*c*, even by modifying the dimensions of ridge 30' in its passage through focuser 2 as is suggested but not described in the above mentioned French patent, the band width is insufficient in certain applications; this is why other constructions have been devised for improving this band width.

FIGS. 2*a* and 2*b* show a coupling device of the invention.

FIG. 2*a* is a longitudinal sectional view which, like FIG. 1*a*, shows a delay line 1 of a travelling wave tube; the line is a helical line disposed inside a focuser 2, with alternate annular magnets, equipped with cooling fins such as 25. As in the assembly shown in FIG. 1*a*, one of the magnets 20 of the focuser has passing therethrough a small wave guide 3 having a ridge 30 to which, on the one hand, is welded the end of the helix 10 of line 1 and, on the other, the ridge is extended into ridge 40 of a rectangular guide with two ridges 40, 41, which forms the external circuit transmitting the energy of the tube.

FIG. 2*b* is a sectional view through the sectional plane whose line CC is shown in FIG. 2*a*. This view shows the connection of ridge 30 to the helix 10 and its extension into ridge 40.

The coupling device of the assembly shown in FIGS. 2*a*, 2*b* differs mainly from that shown in FIGS. 1*a*, 1*b* by:

- a bend in the plane E of guides 3 and 4, that is to say in a plane parallel to their small sides,
- a structure different from guides 3 and 4 and their ridges.

The bend is a right angled bend situated at the junction of guides 3 and 4; its purpose is mainly to allow guide 4 to be disposed parallel to tube 1 so as to reduce the space required by the assembly; accessorily, it provides better cooling of the tube, some of its cooling fins being brazed to guide 4 and therefore benefitting from its mass for the flow of heat coming from tube 1.

The difference in structure of guides 3 and 4 and their ridges with respect to the assembly shown in FIGS. 1*a*, 1*b* may be studied by considering five successive zones D1 to D5 in guides 3 and 4, the first of which D1 is that where the small guide 3 passes through magnet 20.

In zone D1, guide 3 passes through magnet 20 of the focuser 2; its dimensions and those of its ridge are constant and are chosen so that its characteristic impedance Z1 is fairly close to that of the helix ($Ze \simeq 60$ ohms) so as to obtain very wide band matching: more than an octave.

In zone D2 before reaching the bend, the dimensions of guide 3 and its ridge 30 are progressively increased by arranging for the increase in the dimensions of the guide to be compensated for by those of the ridge for the effects on the characteristic impedance of the guide; thus, in zone D2, the small guide 3 has a constant characteristic impedance equal to Z1. The length of zone D2 depends on the standing wave ratio (SWR) admissible in the working frequency band. With a length corresponding to a quarter of the mean wave length in band 4.75–11 GHz an SWR was measured less than or equal to 1.92 in this band, and, with a length equal to three quarters of this mean wave length, an SWR was measured less than or equal to 1.29.

In zone D3, where the bend is situated, the dimensions continue to increase while keeping the same characteristic impedance; for ridge 30, the increase continues until it reaches the dimensions of ridge 40, for the large side of the small guide 3 until it reaches the dimension of the large side of guide 4 and for the small side of guide 3 until a dimension is reached which is less than that of guide 4 at the junction point; thus there is a progressive transition for ridges 30, 40 and the small sides and a sudden transition for the large sides; ridge 41 ends in a short circuit Y in the plane of the junction of guides 3 and 4. From this junction plane, the two ridges 40, 41 of guide 4 are present and guide 4 has small and large sides whose dimensions will not vary. The characteristic impedance which was $Z1=60$ ohms before the junction plane has passed to the value $Z2=62$ ohms.

In zone D4, the spacing between ridges 40 and 41 of guide 4 is increased in successive steps so as to provide a progressive impedance change by increasing the characteristic impedance of guide 4 up to the value $Z3=156$ ohms in zone D5.

In zone D5 and beyond guide 4 is a guide with double ridge of standard dimensions, commercialized under the reference WRD 475 D24 and having a characteristic impedance equal to Z3 and a cross section of 27.68 mm × 12.85 mm. Conventionally, guide 4 has, in its part not shown in FIG. 2*a*, a wide band sealed window.

The impedance change, in zone D4, which makes it possible to lower the characteristic impedance of the double ridge guide 4, before reaching the junction plane with the single ridge small guide 3, is necessary for maintaining the pass band of the double ridge standard guide; this change may not only be achieved as shown in FIG. 3*a* by means of a successive step transformer of the Tchebycheff type, but also by a linear, exponential, cosinusoidal, parabolic type impedance transformer.

FIGS. 3*a*, to 3*d* are sectional views of guides 3 and 4 of another coupling device of the invention which is only distinguished from that shown in FIGS. 2*a*, 2*b* by the fact that guides 3 and 4 are in the extension of each other, that is to say do not form a bend. FIG. 3*a* is a longitudinal section whereas sections 3*b*, 3*c*, 3*d* are cross sections whose respective section planes have been shown in FIG. 3*a*. All that has been said in connection with the guides 3 and 4 of FIGS. 2*a*, 2*b* is applied to guides 3 and 4 of FIGS. 3*a* to 3*d* except for the bend, as is clear from the Figs. FIG. 3*a* is particularly interesting because it shows the short circuiting, at Y, of ridge 41 of guide 4 in the junction plane with the small guide 3.

Figure 5:
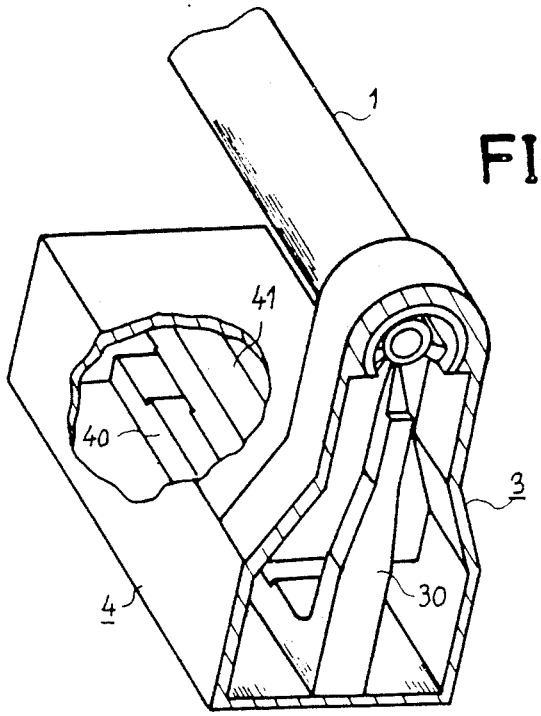
Figure 6:
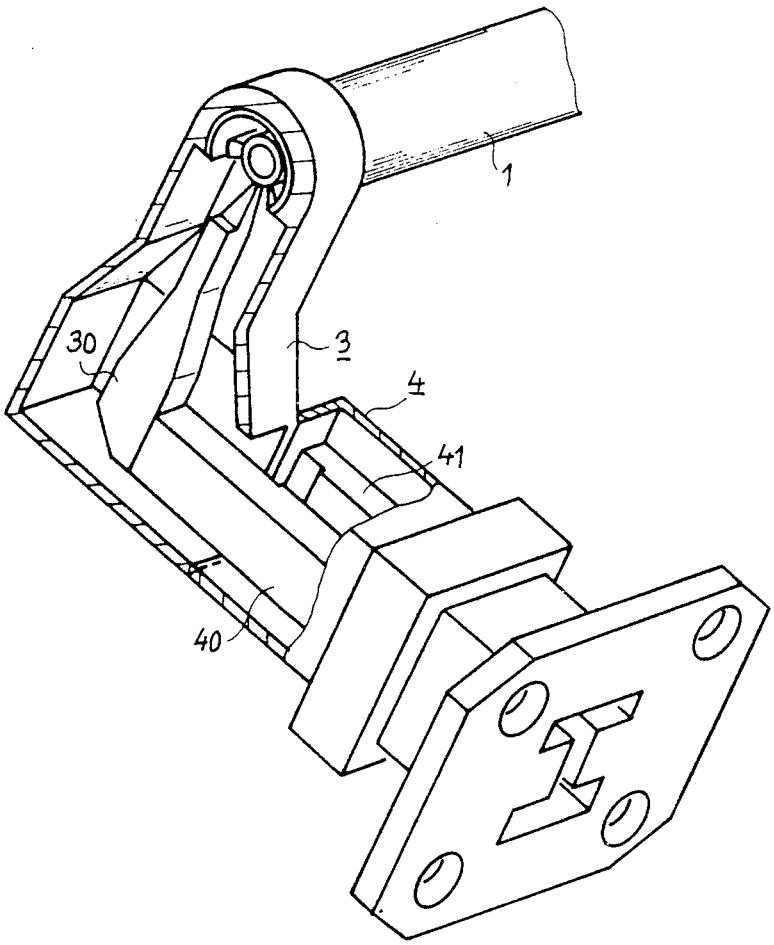

FIGS. 4, 5 and 6 are partial perspective views showing different coupling device variants of the invention; in these Figs., in which the focusers have not been shown, parts have been cut away so as to show how the ridges of the guides are provided.

FIG. 4 is a view which corresponds to the construction shown in FIGS. 2*a*, 2*b*, that is to say a construction with a curve in plane E and with the ridge 30 of the small guide 3 which is connected to that one, 40, of the two ridges of guide 4 which is the closest to the delay line 1; the short circuited end Y of the other ridge 41 of guide 4 is shown in FIG. 4.

FIG. 5 corresponds to FIG. 4 except that ridge 40, which is connected to ridge 30 of the small guide 3, is that one of the two ridges of guide 4 which is the furtherst away from the delay line 1.

FIG. 6 is a construction with a curve in plane H, that is to say the construction in which guide 4 is disposed orthogonally with respect to the delay line 1.

The present invention is not limited to the examples described, thus, in particular, guide 3 could include a second ridge. Similarly, when it is required to provide a bend with guides 3 and 4, this bend cannot be at the level of the junction plane of these guides but somewhere in guide 3 or in guide 4.

What is claimed is:

1. A coupling device between the delay line of a travelling wave tube and the external circuit transmitting the energy of the tube, comprising:

- a first wave guide having a first and a second ridge located within said waveguide;
- a second wave guide coupling in a junction plane to the first wave guide and having a single ridge located within said waveguide, this single ridge having one end connected to the delay line and one end connected to the first ridge, said second ridge being short circuited in the junction plane, said first guide comprising an impedance transformer, said second guide being with substantially constant impedance and the inside width of said second guide being at least substantially equal to that of the first guide in the junction plane and decreasing in the direction of the delay line.

2. A device as claimed in claim 1, wherein the impedance transformer is formed by varying the spacing between the first and second ridges over a given length from the junction plane.

3. A device as claimed in any one of the preceding claims, wherein the assembly formed by the two guides is bent.

* * * * *